US005863053A

United States Patent [19]

Berry

[11] Patent Number: 5,863,053

[45] Date of Patent: Jan. 26, 1999

[54] SEPARABLE MECHANIC'S CREEPER

[76] Inventor: Billy Joe Berry, 2640 E. 800 South, North Judson, Ind. 46366-9998

[21] Appl. No.: 678,571

[22] Filed: Jul. 12, 1996

[51] Int. Cl.[6] ..... B25H 5/00

[52] U.S. Cl. ..... 280/32.6; 280/639

[58] Field of Search ..... 280/32.5, 32.6, 280/79.11, 639, 640, 651

[56] References Cited

U.S. PATENT DOCUMENTS

| | | | |
|---|---|---|---|
| D. 270,962 | 10/1983 | Martell | 280/32.6 |
| D. 289,815 | 5/1987 | Quinonez | D34/23 |
| 1,184,487 | 5/1916 | Peterson | 280/32.6 |
| 1,302,301 | 4/1919 | Broome | 280/32.6 |
| 1,394,493 | 10/1921 | Grazer | 280/32.6 |
| 1,450,092 | 3/1923 | Leavitt | 280/79.11 |
| 4,060,252 | 11/1977 | Mowery | 280/79.11 |
| 4,580,799 | 4/1986 | Quinonez | 280/639 |
| 4,889,352 | 12/1989 | Chamberlin, Jr. et al. | 280/32.6 |
| 4,934,720 | 6/1990 | Dobron | 280/79.11 |
| 5,022,670 | 6/1991 | Cote et al. | 280/32.6 |
| 5,297,809 | 3/1994 | Chen | 280/32.6 |
| 5,451,068 | 9/1995 | Shockley | 280/32.6 |
| 5,524,915 | 6/1996 | Liu | 280/32.6 |
| 5,599,031 | 2/1997 | Hodges | 280/79.11 |
| 5,611,552 | 3/1997 | Miles et al. | 280/32.6 |
| 5,624,126 | 4/1997 | Vosbikian et al. | 280/32.6 |

FOREIGN PATENT DOCUMENTS

| | | | |
|---|---|---|---|
| 738393 | 8/1943 | Germany | 280/32.6 |

*Primary Examiner*—J. J. Swann
*Assistant Examiner*—David Dunn
*Attorney, Agent, or Firm*—Gary M. Hartman; Domenica N. S. Hartman

[57] ABSTRACT

A mechanic's creeper composed of two separable sections. One of the sections is configured to be used as a seat, but is otherwise coupled with the other section to form the creeper. The separable sections are coupled in a manner that enables the sections to be coupled and uncoupled while a user remains seated on the seat portion. The creeper is also adapted to accommodate attachments that can be interchangeably coupled to the seat portion.

17 Claims, 1 Drawing Sheet

SEPARABLE MECHANIC'S CREEPER

The present invention generally relates to creepers of the type used by mechanics to work around and beneath vehicles. More particularly, this invention is directed to a two-piece creeper that is adapted to support a user in a prone position and also easily disassembled so that one portion of the creeper may be used separately as a seat.

BACKGROUND OF THE INVENTION

Creepers are used to provide support for users in a variety of applications, an important example of which is the use of creepers by mechanics to provide mobile support while working on the underside of vehicles. Creepers generally include wheels attached to the lower side of a unitary panel or assembled body. The wheels are adapted to provide multidirectional mobility to the creeper while supporting the user, and enable the user to work in environments with low vertical clearances. For a creeper to perform as intended, it must have an adequately rigid and strong construction to support the entire weight of the user. Yet, creepers that are constructed with a one-piece design are often cumbersome and awkward to store due to their size.

Several prior art creepers have been suggested that provide the necessary support to the user while and are capable of being collapsed for efficient storage. For instance, both U.S. Pat. No. 4,580,799 to Quinonez and U.S. Pat. No. 4,889,352 to Chamberlin, Jr. et al. disclose creepers formed by two hinged sections. These creepers can be folded in order to reduce their overall size when not in use. A mechanic using such a creeper must remove himself or herself from the creeper before collapsing the creeper.

Other prior art creepers have been suggested that are composed of two sections that can be separated. For instance, U.S. Pat. No. 5,022,670 to Cote et al. discloses a creeper that is constructed of two separable panels. The separability of the creeper is intended to enable the creeper to enter a confined space, particularly an attic. Notably, the panels are connected such that they are not coplanar, but are instead joined at an angle of less than 180 degrees. This aspect of the creeper is essential to allow the user to move the creeper over uneven surfaces, such as ceiling joists in an attic. The two panels are coupled by a pair of bars that are bent at an angle. The bars are secured to one panel and receivable within a pair of channels formed in the second panel. Each bar is secured to a respective channel by a locking pin that is accessible through a lower surface of the creeper. The creeper is supported by a number of small wheels located along each side of the creeper, with the wheels being adapted to permit mobility in only the longitudinal direction of the creeper.

The creeper to Cote et al. is designed to address the difficulties of working on uneven surfaces. Although composed of separable panels, the creeper does not allow the panels to be easily separated while in use, since the locking pins are located on the lower surface of the creeper inboard of the wheels. The separability of this creeper is further complicated by its wheels, which necessarily have small diameters and are closely spaced to facilitate mobility over uneven surfaces. The small diameter wheels reduce the clearance beneath the creeper, making it essentially impossible to gain access to the locking pins while the user is seated on the creeper.

Another separable creeper is shown in U.S. Pat. No. 5,297,809 to Chen. The purpose of Chen's separable creeper is to allow easy portability, packing and shipment. According to Chen, two panels are joined by use of a dovetail mortise and holes attached perpendicularly to a first of the panels, and a dovetail tenon and posts attached perpendicularly to the second panel. The panels are attached by engaging the dovetail tenon into the dovetail mortise and the posts into the corresponding holes extending through the second panel. Consequently, the method by which the panels are connected and separated is rather difficult. Furthermore, the design requires a manufacturing process by which each post and its corresponding hole are fabricated within relatively close tolerances, such that the fit between each post-hole combination contributes stiffness to the creeper and thereby provides adequate support the weight of the user. Similarly, the dovetail mortise and the dovetail tenon must also be close-fitting. Notably, assembly and disassembly of this creeper require the panels to be separated by moving one of the panels in a perpendicular direction relative to the plane of the creeper. Therefore, if the user desires to disassemble the creeper while remaining seated, the panel with the posts must be raised perpendicular to the creeper with sufficient force to disengage the posts with their holes and the disengage the dovetail tenons with their dovetail mortices, a rather difficult operation to perform while seated. Accordingly, Chen's creeper cannot be easily assembled and disassembled while supporting the user.

From the above, it can be seen that it would be desirable to have a creeper composed of separable portions that can be readily disassembled, even if the user remains seated on one of the portions. It would be further desirable if such a creeper was more versatile than prior art creepers, so as to enable use of the creeper under a wider variety of circumstances.

SUMMARY OF THE INVENTION

It is an object of this invention to provide a separable creeper whose individual sections can be readily separated.

It is another object of this invention that such a creeper is adapted to be separated while the user remains seated.

It is yet another object of this invention that at least one section of the creeper is specifically configured to serve as a seat for the user.

In accordance with this invention, a creeper is provided composed of separable sections that are capable of being easily separated while the user remains seated on one of the sections. Generally, the creeper of this invention includes a seat portion joined in a longitudinal direction to a back portion, such that the seat and back portions are approximately coplanar. The seat and back portions are configured to be joined in the longitudinal direction by use of an uncomplicated coupling member. When the coupling member is adapted to provide that the seat and back portions are coupled and decoupled by moving the seat and back portions relative to each other in the longitudinal direction. A locking member secures the coupling member when engaged. The locking member is disposed along the lateral sides of the creeper, and is operable in the transverse direction such that the user has access to the coupling member while seated.

As can be seen from above, an advantageous aspect of this invention is that the seat and back portions are separable, a feature that is particularly useful when it is desirable to store the creeper in a vehicle or other location where space is constricted. Furthermore, the ease with which the seat and back portions are separated is promoted by the type of coupling member used, by which the seat and back portions are separated by relative movement in the longitudinal direction. Yet another advantage of this invention is that the user can assemble and disassemble the creeper while remaining seated on the seat portion. This aspect of the invention increases the versatility of the creeper by enabling the user to quickly uncouple the seat portion from the back portion while seated on the seat portion, such that the creeper is quickly converted from a reclining creeper to a seat creeper. This capability is the result of the locking member being purposely located where it will be readily accessible to the user, even while the user remains seated. For instance, a mechanic working on a vehicle using the creeper of this invention may couple the seat portion to the back portion so that the user can lie in a prone position and, when it is desirable to work around the vehicle while sitting up, the user may quickly separate the seat portion from the back portion by unlocking the locking member and uncoupling the seat portion from the back portion. An additional advantage resulting from this aspect of the invention is that an attachment, such as a tool tray, can be readily coupled to the seat portion in place of the back portion, thereby further promoting the versatility of the creeper.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
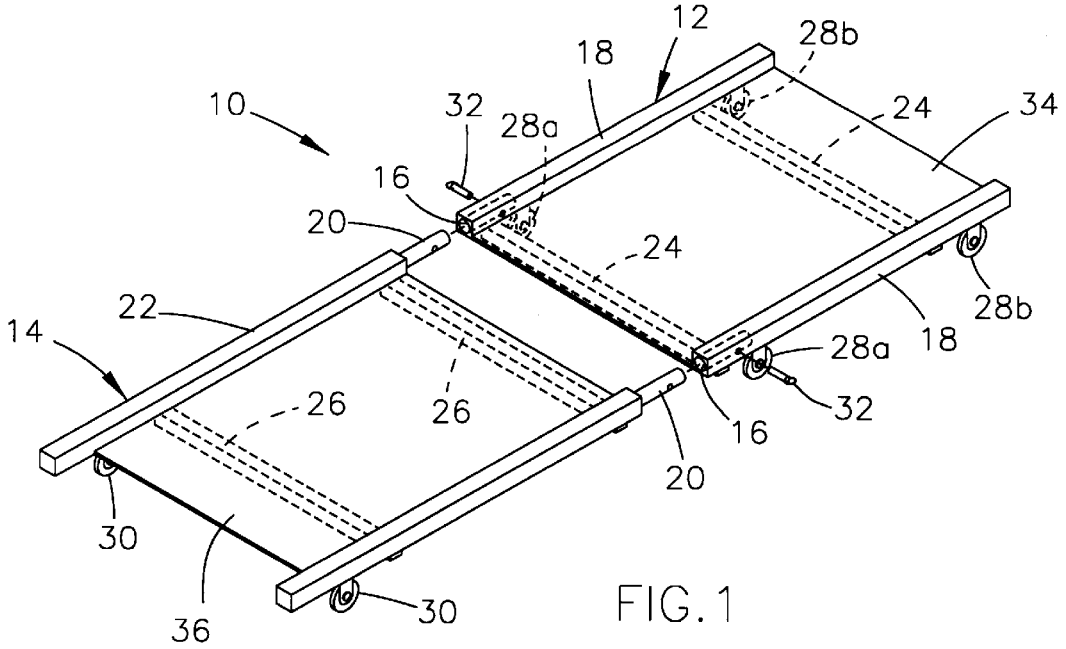
FIG. 1 shows a perspective view of a mechanic's creeper composed of two separable sections in accordance with a preferred embodiment of this invention.
Figure 2:
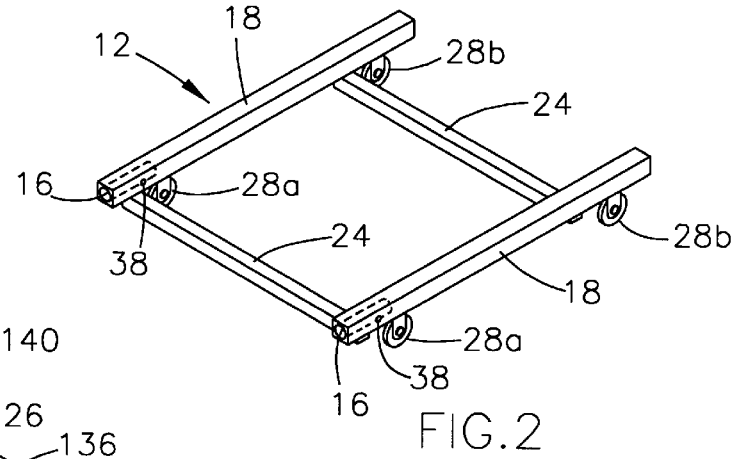
FIG. 2 is a partial perspective view of the first section of the creeper of FIG. 1.
Figure 3:
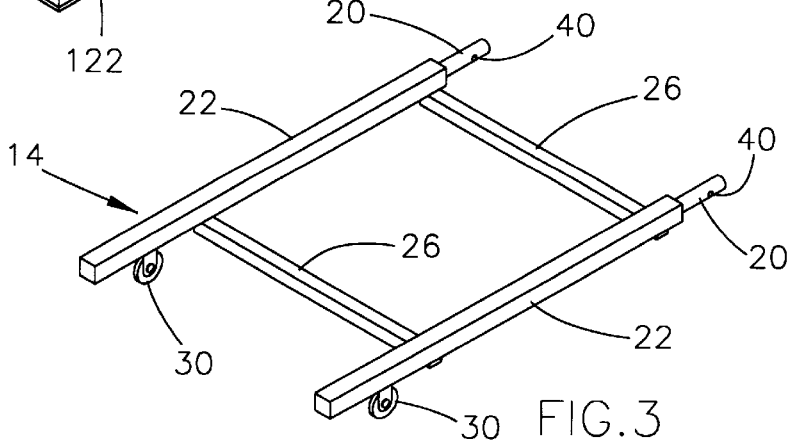
FIG. 3 is a partial perspective view of the second section of the creeper of FIG. 1.

As can be seen with reference to FIG. 1, a two-piece creeper 10 is provided that includes a seat portion 12 and a back portion 14. As shown in FIG. 1, both the seat portion 12 and the back portion 14 are each equipped with a support panel 34 and 36, respectively. In addition, the seat and back portions 12 and 14 have side frames 18 and 22, respectively, disposed parallel to each other in a longitudinal direction, as more readily seen in FIGS. 2 and 3, respectively. Preferably, the side frames 18 of the seat portion 12 are shorter in the longitudinal direction relative to the side frames 22 of the back portion. With further reference to FIGS. 2 and 3, the seat and back portions 12 and 14 include a pair of parallel cross-members 24 and 26, respectively, disposed in a transverse direction. The side frames 18 of the seat portion 12 include a pair of sleeves 16 oriented in the longitudinal direction. The sleeves 16 are sized to receive a corresponding pair of posts 20 that extend from the side frames 22 of the back portion 14 in the longitudinal direction. By mating the posts 20 with their corresponding sleeves 16, the seat portion 12 is coupled with the back portion 14 at an angle of approximately 180 degrees, i.e., the seat and back portions 12 and 14 are approximately coplanar. This aspect of the invention minimizes the amount of vertical space the creeper 10 occupies while in use.

As shown in FIG. 1, the seat portion 12 is secured to the back portion 20 with a pair of locking pins 32 that are accessible to the user while in use. More particularly, each sleeve 16 has a hole 38 formed therein and each corresponding post 20 has a hole 40 formed therein, the holes 38 and 40 being complementary and extending in the transverse direction of the creeper 10. As such, each locking pin 32 can be simultaneously inserted through the holes 38 and 40 of a mated pair of the sleeves and posts 16 and 20, respectively. The locking pins 32 are inserted from the lateral exteriors of the sleeves 16, i.e., the lateral sides of the creeper 10, thus providing easy access to the locking pins 32 by the user, even while the user remains seated on the creeper 10.

The creeper 10 of this invention further includes wheels 28*a*, 28*b* and 30 attached to the side frames 18 and 22 to provide both stability and mobility to the creeper 10. Preferably, the wheels 28*a*, 28*b* and 30 are castor wheels that facilitate mobility both in the longitudinal direction and in the transverse direction. In a preferred embodiment, two pairs of the wheels 28*a* and 28*b* are oppositely disposed on the side frames 18, while the single pair of wheels 30 are located on the back portion 14 opposite the posts 20. The wheels 28*a* and 28*b* are specifically located on the side frames 18 to provide maximum stability to the seat portion 12 when disassembled from the back portion 14. The wheels 28*a* and 28*b* are also preferably located at the extreme comers of the seat portion 12, so as to reduce the likelihood of the seat portion 12 tipping or flipping when separated from the back portion 14. Finally, the wheels 28*a* nearest the sleeves 16 are preferably adapted to be locked, such as castors having a locking feature of a type known and commercially available in the art, to render at least one of these wheels 28*a* selectively immobile when desired. As such, the stability of the seat portion 12 is further promoted when used as a seat apart from the back portion 14.

Figure 4:
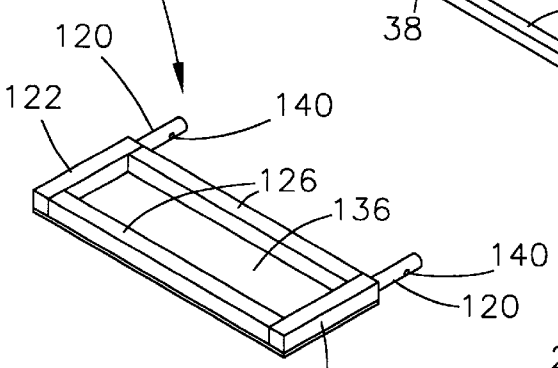
FIG. 4 is a perspective view of a tool tray that can be coupled with the first section shown in FIG. 2.

Shown in FIG. 4 is a tool tray 114 adapted to be readily coupled to the seat portion 12 in place of the back portion 14, and thereby promote the versatility of the creeper 10. As with the back portion 14, the tray 114 is shown as being formed to include a support panel 136, side frames 122 and cross-members 126. The side frames 122 of the tray 114 include a pair of posts 120 that, as with the posts 20 of the back portion 14, are sized to be received within the sleeves 16 of the seat portion 12, and cause the tray 114 to be cantilevered from the seat portion 12. As such, the tray 114 can be readily interchanged with the back portion 14 while the user remains seated on the seat portion 12. Transverse holes 140 extending through the posts 120 enable the tray 114 to be locked to the seat portion 12 with the locking pins 32.

As can be seen from the above, the creeper 10 of this invention has several important advantages, one of which is that the seat portion 12 is readily separable from the back portion 14. This aspect of the invention allows the seat portion 12 to be stored separately from the back portion 14, which is particularly useful when storage space is limited. More notably, the seat portion 12 is separable from the back portion 14 even when the user remains seated on the seat portion 12. Furthermore, separation of the seat and back portions 12 and 14 yields a seat creeper that can be used completely independently of the back portion 13. For example, while sitting on the seat portion 12, the user can easily separate the back portion 14 from the seat portion 12 by removing the locking pins 32 that are accessible from the lateral sides of the creeper 10, and then sliding the back portion 14 away from the seat portion 12 in the longitudinal direction. The shorter length of the seat portion 12 relative to the back portion 14 increases the mobility of the seat portion 12 when detached from the back portion 14, and placement of the wheels 28 at the comers of the seat portion 12 promotes its stability. Suitability of the seat portion 12 as a seat is further promoted by the ability to lock the wheels 28*a*, which provides the user with a more stable platform from which to work. Finally, attachments such as a tool tray 114 can be readily coupled to the seat portion 12 in place of the back portion 14, a capability that greatly promotes the versatility of the creeper 10 of this invention.

While our invention has been described in terms of preferred embodiments, it is apparent that other forms could be adopted by one skilled in the art, such as by incorporating the novel features of this invention with other similar creepers that differ in appearance from that shown in the Figures, or providing various other types of interchangeable attachments in place of the tool tray shown in the Figures. Accordingly, the scope of our invention is to be limited only by the following claims.

What is claimed is:

1. A creeper having a longitudinal direction and a transverse direction, the creeper comprising:

a seat portion;

a back portion associated with the seat portion, the back portion being adapted to couple with the seat portion in the longitudinal direction so as to yield the creeper, the creeper thereby having opposed lateral sides disposed in the longitudinal direction and spaced apart in the transverse direction;

means for coupling the seat portion and the back portion;

means disposed at at least one of the lateral sides of the creeper for locking the coupling means, the locking means being accessible and operable from the lateral sides of the creeper so as to enable coupling and decoupling of the seat and back portions while a user is seated on the seat portion; and an attachment adapted to couple with the seat portion in the longitudinal direction, the coupling means and the locking means being adapted to couple the attachment with the seat portion such that the attachment is cantilevered from the seat portion wherein the attachment is interchangeable with the back portion.

2. A creeper as recited in claim I wherein the locking means is operable in the transverse direction of the creeper.

3. A creeper as recited in claim 1 wherein the coupling means is adapted to cause coupling and uncoupling of the seat and back portions by movement of at least one of the seat and back portions in the longitudinal direction.

4. A creeper as recited in claim 1 wherein the coupling means comprises posts and complementary sleeves, each post having a hole disposed in the transverse direction, each post extending longitudinally from one of the seat and back portions, each sleeve having a hole disposed in the transverse direction, each sleeve extending longitudinally from one of the seat and back portions, the holes in the posts being complementary to the holes in the sleeves when the posts are received in the sleeves.

5. A creeper as recited in claim 1 wherein the locking means comprises locking pins, each locking pin being insertable into complementary pairs of the holes of the posts and sleeves to couple the back portion to the seat portion in the longitudinal direction.

6. A creeper as recited in claim 1 further comprising a first plurality of wheels attached to the seat portion and a second plurality of wheels attached to the back portion.

7. A creeper as recited in claim 6 wherein at least one of the first plurality of wheels comprises a locking feature to render the at least one wheel immobile.

8. A creeper as recited in claim 1 wherein the seat portion comprises:

a pair of first side frames disposed in the longitudinal direction; and a pair of first cross members disposed between the first side frames in the transverse direction and interconnecting the first side frames.

9. A creeper as recited in claim 8 wherein the coupling means comprises a pair of sleeves, each sleeve extending in the longitudinal direction from a corresponding one of the first side frames.

10. A creeper as recited in claim 8 wherein the back portion further comprises:

a pair of second side frames disposed in the longitudinal direction;

a pair of second cross members disposed between the second side frames in the transverse direction and interconnecting the second side frames.

11. A creeper as recited in claim 10 wherein the coupling means comprises a pair of posts, each post extending in the longitudinal direction from a corresponding one of the second side frames.

12. A creeper as recited in claim 10 further comprising:

two pairs of first wheels, each pair of first wheels being oppositely disposed on the first side frames; and a pair of second wheels, the second wheels being disposed on the second side frames and oppositely disposed from the coupling means.

13. A creeper as recited in claim 1 wherein the seat portion has a length in the longitudinal direction that is less than a length of the back portion in the longitudinal direction.

14. A two-piece mechanic's creeper having a longitudinal direction and a transverse direction, the creeper comprising:

a seat portion having a pair of first side frames disposed in the longitudinal direction;

a back portion having a pair of second side frames disposed in the longitudinal direction;

a pair of posts extending in the longitudinal direction from the second side frames, each post having a hole disposed in the transverse direction;

a pair of sleeves extending from the first side frames, each sleeve having a hole disposed in the transverse direction, each sleeve being sized to receive a corresponding one of the posts;

a pair of locking pins associated with the sleeves and posts, each locking pin being insertable in the transverse direction into a complementary pair of holes formed by the holes in the sleeves and posts when the posts are received within the corresponding sleeves, the locking pins thereby locking the back portion to the seat portion at an angle of approximately 180 degrees relative to the seat portion in the longitudinal direction;

a tray adapted to couple with the seat portion in the longitudinal direction so as to be cantilevered from the seat portion, the tray having a pair of posts extending in the longitudinal direction therefrom, each post of the tray having a hole disposed in the transverse direction, the posts of the tray being sized to be received in the sleeves of the seat portion and the holes in the posts being adapted to receive the locking pins in the transverse direction through the holes in the sleeve so as to couple the tray to the seat portion, wherein the tray is interchangeable with the back portion;

at least two pairs of first wheels, each of the pair of first wheels being oppositely disposed on the first side frames; and at least one pair of second wheels, each of the pair of second wheels being disposed on the second side frames and oppositely disposed from the posts.

15. A creeper as recited in claim 14 wherein at least one of the first wheels comprises a locking feature to render the at least one wheel immobile.

16. A separable creeper as recited in claim 17 further comprising a tray adapted to couple with the seat portion in the longitudinal direction so as to be cantilevered from the seat portion, wherein the tray is interchangeable with the back portion.

17. A separable creeper having a longitudinal direction and a transverse direction, the creeper comprising:

a seat portion;

a back portion coupled with the seat portion, the back portion and the seat portion being coupled and decoupled by moving the seat and back portions relative to each other in the longitudinal direction, the creeper thereby having opposed lateral sides disposed in the longitudinal direction and spaced apart in the transverse direction;

means for coupling the seat portion and the back portion;

means disposed at at least one of the lateral sides of the creeper for locking the coupling means, the locking means being accessible and operable from the lateral sides of the creeper so as to enable coupling and decoupling of the seat and back portions while a user is seated on the seat portion;

at least two spaced-apart pairs of wheels supporting the seat portion so as to render the seat portion stable when supporting the user as the back portion is uncoupled from the seat portion;

a single pair of wheels supporting the back portion, the single pair of wheels being attached to a longitudinal end of the back portion oppositely disposed from the coupling means; and an attachment adapted to couple with the seat portion in the longitudinal direction, the coupling means and the locking means being adapted to couple the attachment with the seat portion such that the attachment is cantilevered from the seat portion wherein the attachment is interchangeable with the back portion.

* * * * *